US005979082A

United States Patent [19]

Pallatin

[11] Patent Number: 5,979,082

[45] Date of Patent: Nov. 9, 1999

[54] SPORTS BOOT HAVING A PREDETERMINED FLEXIBILITY

[75] Inventor: Pascal Pallatin, Les Aillouds, France

[73] Assignee: Salomon S.A., Metz-Tessy, France

[21] Appl. No.: 09/129,421

[22] Filed: Aug. 5, 1998

[30] Foreign Application Priority Data

Aug. 5, 1997 [FR] France ..... 97 10185

[51] Int. Cl.[6] ..... A43B 5/04

[52] U.S. Cl. ..... 36/118.2; 36/118.3

[58] Field of Search ..... 36/118.2, 118.3, 36/118.4, 118.6, 118.7, 118.8

[56] References Cited

U.S. PATENT DOCUMENTS

| | | |
|---|---|---|
| 4,839,973 | 6/1989 | Dodge . |
| 4,864,743 | 9/1989 | Begey et al. . |
| 4,875,299 | 10/1989 | Mabboux et al. . |
| 4,928,406 | 5/1990 | Montfort . |
| 4,962,594 | 10/1990 | Marega et al. . |
| 5,001,849 | 3/1991 | Bidoia . |
| 5,031,341 | 7/1991 | Paris et al. . |
| 5,203,098 | 4/1993 | Perrissoud et al. . |
| 5,353,528 | 10/1994 | Demarchi . |
| 5,363,572 | 11/1994 | Marega et al. . |
| 5,524,366 | 6/1996 | Caeran . |
| 5,526,588 | 6/1996 | Freisinger et al. . |
| 5,718,066 | 2/1998 | Chemello et al. . |

FOREIGN PATENT DOCUMENTS

| | | |
|---|---|---|
| 0350023 | 1/1990 | European Pat. Off. . |
| 0666036 | 8/1995 | European Pat. Off. . |
| 0671133 | 9/1995 | European Pat. Off. . |
| 9217787 U | 4/1993 | Germany . |

*Primary Examiner*—Ted Kavanaugh
*Attorney, Agent, or Firm*—Greenblum & Bernstein P.L.C.

[57] ABSTRACT

Boot of the front entry type with variable volume having a shell that includes an upper and a shell base that overlap at least partially in the area corresponding to the dorsal zone of the boot, the upper being pivotally connected to the shell base. A bending mechanism is integrated in its dorsal zone where it is sandwiched between the upper and the shell base on which it is attached and rigidly affixed, and such bending mechanism is formed by a flexible strip that includes a vertical notch, open upwardly and whose delineating edges extend freely beneath the upper. The bending mechanism enables the flexibility characteristics of the boot to be determined.

23 Claims, 2 Drawing Sheets

4'
4
3
1
12
13
2
31
3
22
IV
9
30
33
3
24'
4'
7
3
8
4
13'
IV
19
32
23
33
24'
24
25
27
22'
5

13
12
30
25'
7
25
22
32
31
24

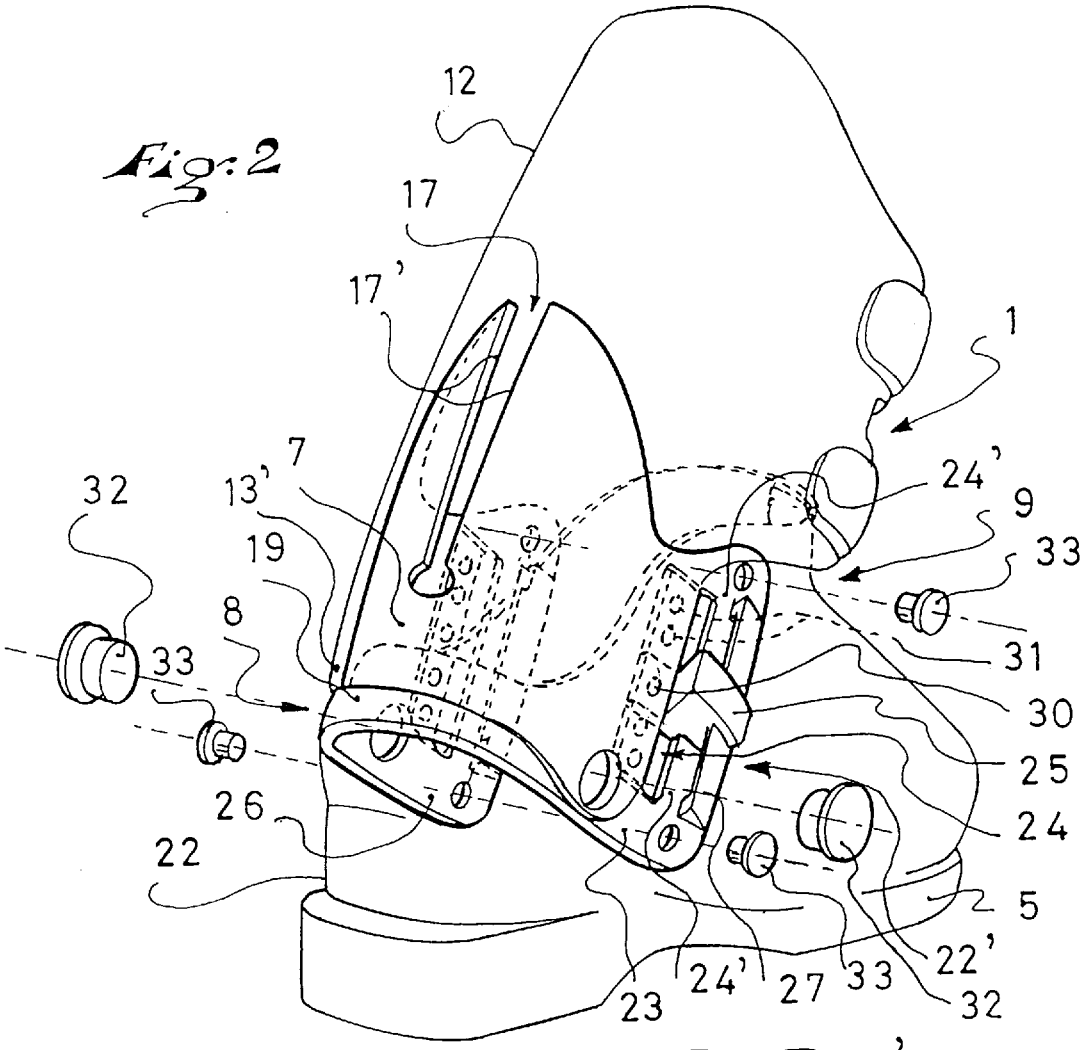
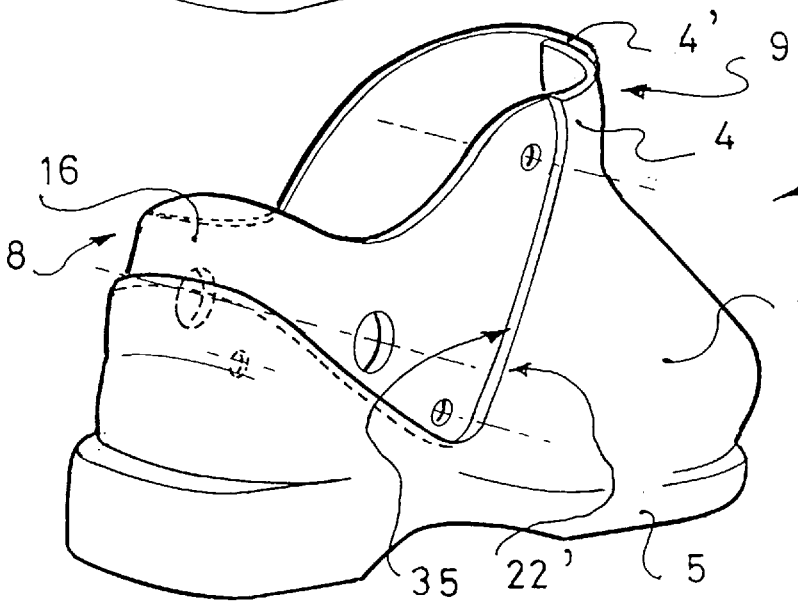
Fig: 3

SPORTS BOOT HAVING A PREDETERMINED FLEXIBILITY

BACKGROUND OF THE INVENTION

1. Field of the Invention

The present invention is related to a sports boot of the front entry type with variable volume having a shell constituted of an upper and a shell base that overlap each other at least partially and that are connected to each other in a pivoting manner; it is also related to a bending mechanism adapted to determine the flexibility characteristics of the upper relative to the shell base.

2. Description of Background and Relevant Information

In known boots of this type, such as the ski boots disclosed in the European patent applications EP 666 036 and EP 671 133, the European patent EP 350 023 and the German Utility Model G 92 17 787.5, the overlapping zone of the upper with the shell base extends approximately along the entire area corresponding to the user's ankle for obvious sealing reasons. More specifically, in the dorsal zone of the boot, the shell base has a more or less thin and flexible vertical extension originating in one piece with its wall, which is nested beneath the lower border of the upper. This vertical extension, which forms the equivalent of a half tube, is slit via a vertical notch, open upwardly, whose demarcating edges extend freely beneath the upper, and at a level located above the pivot axes thereof. By these arrangements, when the upper pivots towards the front, the slit part of the vertical extension can becomes deformed elastically without being buttressed and thus accompany the upper that overlaps it in its movements.

As has been taught, the pivoting of the upper is thus made possible as long as the elastic resistance of the vertical extension, and thus of its slit portion, can be overcome, which implies a relative coming together of the opposing edges demarcating the notch. The bending capacity of the vertical extension consequently determines the flexibility characteristics during the bending of the boot. However, because the vertical extension is made in one piece with the shell base, it is the type of material constituting the shell base that actually determines whether the boot will be more or less flexible, i.e., that imparts it with its initial flexibility.

In view of the fact that the shell base of these types of boots, as is the case with most "variable volume" boots, must be adjusted on the foot by means of tightening devices that adjust the effect of its enveloping, the known solution for obtaining an adapted optimum initial flexibility for each relevant portion of the boot thus consists of varying the thickness of the wall of the shell base, which is made from a given material, most often plastic. To this end, the wall is designed to be thin in the region of the closure flaps of the shell base, and clearly thicker in the region of the slit portion of the vertical extension, as well as in the lower region that extends down to the walking sole.

This design for boots with variable volume enables reaching a good stiffness-flexibility compromise for a given design of boot, as long as the plastic material selected is not too stiff, because in this case it would be necessary to obtain extremely thin walls, perhaps even excessively thin walls, in the areas of the tightening devices, i.e., in areas where the shell base has to be adjusted on the user's foot, as, for example, in the instep zone. In fact, almost always, it is a relatively flexible material that is usually used, which enables defining the various regions of the shell base into wall thicknesses that remain compatible with traditional plastic molding methods, even if there is a need to increase the thickness of the most biased areas.

The boots designed in this manner, i.e., with an increased thickness of the wall especially on the slit portion of the vertical extensions, definitely provide a measure of satisfaction as regards functionality because the flexibility of the upper results from a pulling effect on the dorsal zone of the shell base without any blocking during the entire period that the opposite edges of the notch remain free to come closer together. In addition, by proceeding in this manner, the force that the user applies on the upper is distributed over a large enveloping surface, extending along the entire lower frontal zone of the leg, which means that substantial localized pressures can be avoided. However, this boot design has the disadvantage of making them considerably heavier, and it also does not allow for the development of a base structure that can be common or standard for several boot designs wherein varying initial flexibility characteristics are desired. Indeed, with this object in mind, it becomes necessary to obtain a specific shell base for each design, or even for each level of initial flexibility desired, by varying the choice of the plastic material used and/or by varying the thickness of its walls.

Obviously, it is known to attach and/or associate to the bending slit of the shell base, adjustment devices intended to modify the initial flexibility characteristics that the slit is capable of providing for a given boot design. This is the main focus of the documents EP 666 036, EP 671 133, EP 350 023 and DE G 92 17 787.5 cited previously.

More specifically, the adjustment devices of the boots described in the European documents EP 350 023, EP 666 036, and EP 671 133, act on the opposite edges of the vertical extension notch originating from the shell base, whereas the one from the boot described in the German document G 92 17 787.5 acts directly between the upper and the shell base. Thus, the initial flexibility of the upper can be modified and controlled very easily, both in terms of force as well as in terms of amplitude, by simply varying the value of the space left free between the opposite edges of the notch and/or the height of the notch that is allowed to bend. Obviously, the latter adjustment simultaneously causes a change in the level of the forces to be generated because it modifies the height of the support taken by the upper on the slit portion of the vertical extension with respect to the connecting and pivot axes of the upper. However, it is apparent from these boot constructions that obtaining the vertical slit extension all in one piece with the shell base, once again adversely impacts these types of boots. Indeed, by acting directly, for example, on the edges of the notch with the adjustment devices taught by the documents EP 350 023, EP 666 036 and EP 671 133, the stresses, especially the pressures, are very high in the area of the contact points with the adjustable abutments of these devices, and that they cause a rapid deterioration of the edges of the notch. This deterioration is a result of the fact that the available support surface is limited to the surface offered by the wall thickness of the vertical extension in the area of the notch, and to the surface offered by the ends of the adjustable abutments. Another reason is the fact that the elastic material constituting the vertical extension is the same as that of the shell base, i.e., relatively flexible so as to allow a good stiffness-flexibility compromise, whilst remaining compatible with the traditional molding methods of plastic materials.

Obviously, in the case of the adjustment device taught by the German document G 92 17 787.5, the above-cited disadvantage does not manifest itself because this adjustment device acts directly between the upper and the shell base by using a tension adjustable spring. However, this device extends along the dorsal zone of the boot and, consequently, has a substantial encumbrance in this zone, which must often be relatively clear so as to provide space for the binding and/or affixing systems of the boot on sports devices, such as skis, for example. In addition, this device is relatively complex because it makes use of numerous mechanical elements.

It is clear that regardless of the adjustment devices that are implemented on this type of boot, they are only efficient in the sense that they make the boot less flexible than it was initially by reducing the frontward bending ability of its upper and/or by increasing the level of forces that can be generated on the latter in order to cause it to bend. The adjustment devices of the boots disclosed hereinabove thus necessarily have to provide a specific shell base and/or an "upper-shell base" structure for each boot design, i.e., specific to each level of initial flexibility desired.

SUMMARY OF THE INVENTION

It is an object of the invention to overcome these disadvantages in the above-cited boots in a very simple and efficient manner, while retaining the advantages procured by obtaining a vertical extension slit in the dorsal zone of the shell base.

One specific object of the invention is to provide a shell base structure for a boot that is common and/or standard for several boot designs which must have differing initial flexibility requirements.

Another object is to obtain a light boot, which, though made from a relatively flexible plastic material so as to ensure adjustment and an optimum retention of the user's foot, can also provide, if necessary, a substantial initial resistance to the frontward bending of the upper.

It is also the object of the invention not to substantially modify the outer volume of the boot shell by projecting parts.

In order to achieve these objects, the boot, according to the invention, of the front entry type with variable volume, has a shell constituted of an upper and a shell base that overlap at least partially in the area corresponding to the dorsal zone of the boot, the upper being connected to the shell base via pivot axes, wherein a bending mechanism adapted to determine its bending characteristics is sandwiched between the upper and the shell base on which it is attached and rigidly affixed, and wherein this bending mechanism is formed by a flexible strip slit along a portion of its length via a vertical notch, open upwardly and whose delineating edges extend freely beneath the upper.

According to a preferred embodiment, the notch is positioned in the dorsal zone of the boot shell and the delineating edges extend along a level located above the level of the pivot axes of the upper.

Due to these characteristics, the flexible strip constitutes an extension of the shell base that is functionally equivalent to a slit vertical extension that would have originated in one piece therewith, but which has the advantage of being able to be obtained from a material that is different from that of the shell base. Consequently, depending on whether the material selected for this flexibility strip is more or less resistant to bending, the flexibility of the boot is modified, either by reducing it or by increasing it. The flexible strip thus enables determining the initial base flexibility as desired for any boot design without being dependent on the choice of material used for the shell base. In addition, it enables stiffening the wall for the shell base along the zone wherein it is attached and rigidly affixed, and this is achieved without interfering with the flexibility characteristics that it imparts to the upper of the boot.

Clearly, by virtue of the independence in obtaining the means that determines the initial flexibility of the boot, it becomes easy to design a shell, including the shell base, in a plastic material that is best adapted to ensure the adjustment and retention function of the foot in the boot without having to make provision for excessive increases in thickness at least in those zones of the latter that are biased during the frontward bending of the boot. The bending mechanism according to the invention thus enables designing a base structure for the boot, i.e., a "shell base-upper" or only a shell base, that is common, up to the moment of final assembly, to several boot designs. Indeed, with this object in mind, it suffices to make provisions for a range of more or less flexible strips to obtain just as many boot designs that have differing initial flexibility characteristics. To this end, despite the fact that the flexible strip can be affixed via any known means, such as stitching, riveting, adhesives, or bolt connections etc., preference is given to the most easy to dismount assembly means; this allows the flexibility of the boot to be adapted after its final assembly without having to destroy, even partially, the assembly means.

Once again, by virtue of this independence in obtaining the means adapted to impart the boot with its initial flexibility characteristics, it is possible to select a material having high mechanical characteristics, capable of avoiding the deterioration of the opposite edges of the notch if an adjustment device is provided to cooperate with the latter, as in the boot examples called for in the documents EP 671 133, EP 350 023 and EP 666 036 and disclosed previously.

According to a preferred embodiment, the flexible strip that constitutes the means adapted to determine the flexibility of the upper takes the shape of a relatively thin piece that closely hugs at least a portion of the dorsal zone of the shell base, and that extends laterally along the sides of the latter, for example, up into the zone of the connecting and pivot axes of the upper. The flexible strip thus obtained is perfectly integrated into the outer volume of the shell and surrounds approximately the entire region corresponding to the user's ankle, while leaving the instep zone free, where traditionally, the shell base, on the one hand, has to leave a passage for the user's foot while putting on and taking off the boot, and, on the other hand, be particularly well adjusted to the user's foot so as to retain it without injuring it whilst allowing the frontward bending of the upper.

According to another embodiment of the invention, which flows from the previous embodiment, the flexible strip is obtained with at least one lateral extension that extends along one side of the shell base in the direction of the frontal zone thereof and beyond the connecting and pivot axes of the upper. This extension is equipped with a slide in which a mobile cursor can be adjusted in translation.

This cursor is equipped with a shoulder that projects across from the corresponding lower lateral edge of the upper, and the slide is oriented approximately parallel to such lower lateral edge. By these arrangements, the upper is hampered, to a greater or lesser degree, during frontward pivoting, due to the cursor, and this occurs in addition to the elastic resistance opposed thereto by the slit portion of the flexible strip. Indeed, these arrangements make the boot stiffer to a greater or lesser degree in its entirety because the upper can almost no longer bend frontwardly unless it can get elastically deformed between the support of its lower lateral edge on the cursor and its pivot axes.

The slide for the lateral extension of the flexible strip can be oriented, from the level of the connecting axes of the upper, so as to be diverging with respect to the lower lateral edge thereof. In this construction, the upper can thus bend frontwardly against the elastic resistance opposed in the dorsal zone of the boot by the slit flexible strip, until it regains a support on the cursor with which the slide is equipped. From this abutment position wherein the upper can no longer pivot about its axes, it is the elastic deformation capacity of the upper that plays a role in enabling the frontward movement to be continued. Once again, the slide itself can be provided so as to be deformed elastically under the effect of a force applied on the cursor and directed forwardly via the lower lateral edge of the upper. To this end, the slide can have a flexible portion located between the ends defining its length, affixing elements can be advantageously located in the area of these ends. In this case, the area of the forces to be generated on the upper so as to cause its frontward bending is a function of the elastic resistance opposed by the notched portion of the flexible strip, and the elastic resistance of the slide. The bending mechanism, or the flexible strip, is thus capable, even with a small volume, of opposing an extremely high overall elastic resistance because the frontward flexibility of the upper is a result of a pulling effect on the dorsal zone of the shell base, as well as of a thrusting effect on the frontal zone thereof, at least along one of its sides.

According to a constructional detail of the flexible strip constituting the means adapted to determine the flexibility characteristics of the upper relative to the shell base, such element is obtained in the dorsal zone of the boot with a shoulder that projects outwardly from the boot and against which the upper is mounted in abutment via its back lower edge. The boot constructed in this manner has an upper that is only allowed to bend frontwardly from its assembly position. It is to be understood that the height position of the shoulder in the dorsal zone of the shell base can be determined according to several values that depend on the inclination to be imposed on the upper in its assembly position in support along the rear.

In order to provide as perfect an integration as possible in the overall volume of the boot for the bending mechanism, i.e., the flexible strip, the shell base of the boot is preferably obtained with a housing that extends at least along the entire zone where the flexible strip covers it, so that the latter can be positioned therein.

BRIEF DESCRIPTION OF THE DRAWINGS

The following description, with reference to the annexed schematic drawings, illustrates one embodiment of the invention, in which:

FIG. 2 illustrates, in a perspective view, the bending mechanism of FIG. 1 with the contours of the boot;

FIG. 3 is a perspective view of the shell base of the boot of FIGS. 1 and 2.

DETAILED DESCRIPTION OF THE PREFERRED EMBODIMENTS

Figure 1:
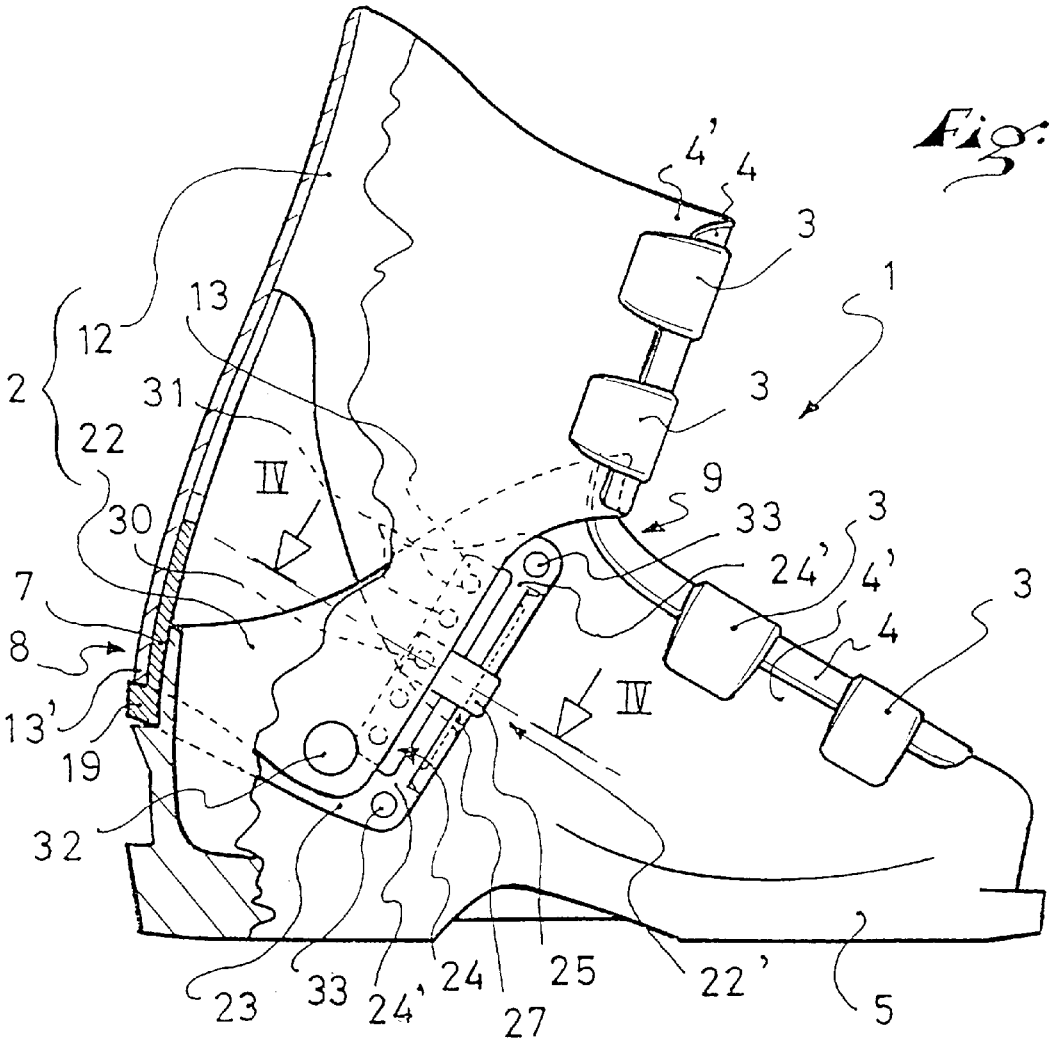
FIG. 1 shows, in a lateral elevational and partial sectional view, a boot having a shell equipped with a bending mechanism adapted to determine the flexibility characteristics of the upper.

The boot represented schematically in FIG. 1, as a non-limiting example, is of the front entry type having a variable volume. It has a shell 2 that includes an upper 12 and a shell base 22 equipped with a sole 5, the component parts 12–22 of the shell 2 being connected pivotally to one another via connecting and pivot axles 32 preferably located in a region that approximately corresponds with that of the ankle journal of the user's foot (not shown). In this type of boot, the boot is put on and taken off conventionally, i.e., by means of an opening in the upper frontal portion 1 of the shell 2, so as to leave a passage for the user's foot, and the adjustment of the foot of the latter is a result of a deformation of the shell 2. More specifically, this deformation is traditionally caused via tightening devices 3 that pull on the transverse flaps 4, 4', that extend the wall of the shell base 22 and of the upper 12, such flaps 4, 4' ensuring the actual closure of the shell 2. In order to guarantee a certain level of sealing and enable the upper 12 to bend relative to the shell base 22 by pivoting about the axles 32, these component parts 12–22 of the shell 2 overlap partially in a zone that is preferably located approximately in the area corresponding to the user's ankle, and they are equipped, in this area, with relatively flexible and thin walls. The upper 12 can thus easily bend relatively to the shell base 22 since these thin and flexible walls provide only a very nominal elastic resistance.

According to one characteristic of the invention, a bending mechanism 7 adapted to determine the flexibility characteristics of the boot is integrated into the rear or dorsal zone 8 thereof. To this end, this mechanism 7 is sandwiched between the upper 12 and the shell base 22 on which it is attached and rigidly affixed, for example, by an assembly device 33, such as rivets or bolts. The bending mechanism 7 is formed of a relatively thin band or flexible strip that is slit along a portion of its length via a vertical notch 17, open upwardly at the upper edge of the flexible strip so that the edges 17' that delineate it extend freely beneath the upper 12 and at a distance from the shell base 22. This vertical notch 17 is preferably positioned in correspondence with the dorsal zone 8 of the boot, such that the resistance to bending that can be opposed by the flexible strip 7 when the upper 12 is biased to pivot frontwardly is approximately centered with respect to the pivot axles 32 thereof. According to certain details, the flexible strip 7 is closely positioned against at least a portion of the shell base 22 located in the dorsal zone 8 of the boot, and then extends laterally along the sides 22' thereof via two extensions 23 and 26 up into the area of the pivot axles 32 where it is affixed by assembly device 33 while leaving the frontal zone 9 corresponding to the instep free. More specifically, one of the extensions 23 is equipped, beyond the pivot axle 32, with a slide 24 in which a cursor 25 slides. This slide 24 is fixed at its two ends 24' on the shell base 22 via assembly device 33 and is oriented parallel to the lower lateral edge 13 of the upper 12 which is in correspondence therewith, and the cursor 25 has a shoulder 25' that projects opposite of this edge 13. By virtue of these arrangements, the upper 12 is prevented from any frontward pivoting and it is only its capacity for elastic deformation that allows it to undertake any frontward movement at all.

Figure 4:
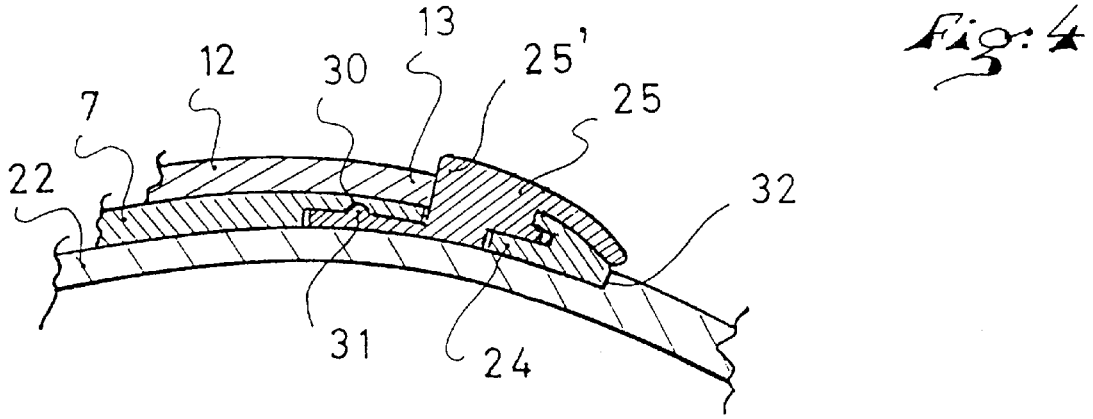
FIG. 4 shows, in a cross section taken along line IV—IV of FIG. 1, how the upper of the boot cooperates with a cursor-slide with which the bending piece is equipped.

Advantageously, the cursor 25 is translationally adjustable in the slide 24 and can be immobilized in position by means of a succession of nesting cavities 30 provided on one edge of the slide, and with which a boss or projection 31 equipping the cursor 25 cooperates, as is visible especially in FIG. 4. Thus, by varying the position of the cursor 25 with respect to the pivot axle 32 of the upper 12, the position of the frontward support point of the upper 12, and thus its lever arms can be correlatively modified. In fact, the bending mechanism 7 arranged in this manner constitutes an adjustable stiffener for the boot enabling the upper 12 to be deformed to a greater or lesser degree according to the position of the cursor 25. By its construction, the bending mechanism 7 also acts as a reinforcement for the shell base 22 in the area where it is the most biased by the upper 12, i.e., in the dorsal zone 8 where the overlapping occurs.

With a view to integrating the bending mechanism 7, or the flexible strip, in the overall volume of the boot, the shell base 22, illustrated in FIG. 3, is obtained with a housing 35 in which the bending mechanism becomes positioned. This housing 35 preferably extends at least along the zone where the bending mechanism 7 covers it and its contour, as is the case in the instant embodiment, and is advantageously contiguous to that of the bending mechanism 7. If implemented in this manner, the slide 24 is embedded on the shell base 22 without any possibility of bending between its assembly device 33 that affix it to the latter.

In case where a certain flexibility is desirable, especially to provide a little more flexibility to the upper 12 when it presses on the cursor 25, a part 27 of the slide 24 that is located between the two ends 24' delineating it can be provided to be flexible. To this end, the contour of the housing 35 obtained in the wall of the shell base 22 is therefore provided, in the area of the slide 24, to be relatively larger than the latter so that its part 27 can bend between these two ends 24'.

According to a constructional detail of the bending mechanism 7, the latter is obtained with a shoulder 19 that projects outwardly from the dorsal zone of the boot and against which the upper 12 is mounted in abutment by its back lower edge 13'. The upper 12 is thus prevented from any rearward tipping from the moment that it takes support on the shoulder 19. In fact, by virtue of the elastic thrust of the edges 17' of the notch 17 on the wall of the upper 12, the latter is biased and permanently returned against such shoulder 19.

The instant application is based upon the French priority patent application No. 97 10185 filed on Aug. 5, 1997, the disclosure of which is hereby incorporated by reference thereto in its entirety, and the priority of which is hereby claimed under 35 USC 119.

What is claimed is:

1. A front-entry boot having a variable volume, said boot comprising:

a shell base;

an upper at least partially overlapping said shell base in a dorsal zone of the boot;

pivot axles connecting said upper to said shell base;

a bending mechanism rigidly secured to said shell base and at least partially sandwiched between said shell base and said upper, said bending mechanism including a flexible strip, said flexible strip including an upper edge, said flexible strip having an upwardly extending notch, said notch being delineated by a pair of upwardly extending edges, said upwardly extending edges extending freely beneath said upper, said notch being upwardly open at said upper edge.

2. A front-entry boot according to claim 1, wherein:

said notch extends upwardly in the dorsal zone of the boot.

3. A front-entry boot according to claim 2, wherein:

said flexible strip is relatively thin and is closely positioned against at least a portion of said shell base in the dorsal zone of the boot, said flexible strip extending laterally from the dorsal zone to respective opposite sides of said shell base.

4. A front-entry boot according to claim 3, wherein:

said flexible strip extends laterally into and terminates at respective pivot zones of said shell base, said pivot axles located at said pivot zones, said flexible strip thereby leaving free a frontal zone of the boot.

5. A front-entry boot according to claim 3, wherein:

said flexible strip comprises a pair of lateral extensions, said laterally extensions extending laterally into and terminating forwardly beyond respective pivot zones of said shell base at respective lower lateral edges, said pivot axles located at said pivot zones, said flexible strip not extending to a frontal zone of the boot;

each of said lateral extensions has a slide with a translationally adjustable cursor, each of said cursors having a shoulder in translationally movable engagement with a respective one of said lower lateral edges of said lateral extensions.

6. A front-entry boot according to claim 5, wherein:

each of said slides has a respective length delineated by respective upper and lower ends, each of said slides having flexible portion located between said ends.

7. A front-entry boot according to claim 1, wherein:

said flexible strip has an shoulder outwardly projecting from the dorsal zone of the boot;

said upper has a rear lower edge in abutment with said shoulder.

8. A front-entry boot according to claim 1, wherein:

said shell base has a recessed housing, said flexible strip being positioned within and entirely covering said recessed housing.

9. A front-entry boot according to claim 1, wherein:

said flexible strip is secured to said shell base by means of a removable assembly device.

10. A front-entry boot according to claim 1, wherein:

said flexible strip and said shell base are made from different materials.

11. A front-entry boot having a variable volume, said boot comprising:

a shell base having a rear zone and opposite lateral zones extending from said rear zone;

an upper having a rear portion at least partially overlapping said shell base in said rear zone;

axles connecting said upper to said shell base to allow for flexional movement of said upper forwardly and rearwardly with respect to said shell base;

a flexible band secured to said shell base against pivoting of said flexible band with respect to said shell base, said flexible band at least partially sandwiched between said shell base and said upper, said flexible band including an upper edge, said flexible band having an upwardly extending notch, said notch being delineated by a pair of upwardly extending edges, said upwardly extending edges extending freely beneath said upper, said notch being upwardly open at said upper edge.

12. A front-entry boot according to claim 11, wherein:

said notch extends upwardly in a part of said flexible band corresponding to said rear portion of said upper.

13. A front-entry boot according to claim 12, wherein:

said flexible band is relatively thin and is closely positioned against at least a portion of said rear zone of said shell base, said flexible band extending laterally from said rear zone to respective opposite sides of said shell base.

14. A front-entry boot according to claim 13, wherein:

said flexible band extends laterally into and terminates at respective zones of said shell base at which said axles are located, said flexible band thereby leaving free a frontal zone of the boot.

15. A front-entry boot according to claim 13, wherein:

said flexible band comprises a pair of lateral extensions, said laterally extensions extending laterally into and terminating forwardly beyond respective zones of said shell base at respective lower lateral edges at which said axles are located, said flexible band not extending to a frontal zone of the boot;

each of said lateral extensions has a slide with a translationally adjustable cursor, each of said cursors having a shoulder in translationally movable engagement with a respective one of said lower lateral edges of said lateral extensions.

16. A front-entry boot according to claim 15, wherein:

each of said slides has a respective length delineated by respective upper and lower ends, each of said slides having flexible portion located between said ends.

17. A front-entry boot according to claim 11, wherein:

said flexible band has an shoulder outwardly projecting from said rear zone of said shell base;

said upper has a rear lower edge in abutment with said shoulder.

18. A front-entry boot according to claim 11, wherein:

said shell base has a recessed housing, said flexible band being positioned within and entirely covering said recessed housing.

19. A front-entry boot according to claim 11, wherein:

said flexible band is secured to said shell base by means of a removable assembly device.

20. A front-entry boot according to claim 11, wherein:

said flexible band and said shell base are made from different materials.

21. A front-entry boot according to claim 11, wherein:

said shell base has overlapping flaps and said upper has overlapping flaps, said overlapping flaps providing for entry of the foot of a wearer of the boot;

adjustable tightening devices for tightening said overlapping flaps against the foot of the wearer of the boot.

22. A front-entry boot according to claim 11, wherein:

said shell base includes a sole.

23. A front-entry boot having a variable volume, said boot comprising:

a shell base having a rear zone and opposite lateral zones extending from said rear zone;

an upper having a rear portion at least partially overlapping said shell base in said rear zone;

axles connecting said upper to said shell base to allow for flexional movement of said upper forwardly and rearwardly with respect to said shell base;

means for adjusting resistance to said flexional movement of said upper with respect to said shell base, said means comprising a flexible band secured to said shell base, said flexible band at least partially sandwiched between said shell base and said upper, said flexible band including an upper edge, said flexible band having an upwardly extending notch, said notch being delineated by a pair of upwardly extending edges, said upwardly extending edges extending freely beneath said upper, said notch being upwardly open at said upper edge.

* * * * *